United States Patent [19]

Honda

[11] 4,144,736

[45] Mar. 20, 1979

[54] DIE FORGING PRESS

[75] Inventor: Eiichi Honda, Osaka, Japan

[73] Assignee: Sumitomo Metal Industries, Ltd., Osaka, Japan

[21] Appl. No.: 840,004

[22] Filed: Oct. 6, 1977

[30] Foreign Application Priority Data

Oct. 30, 1976 [JP] Japan ..... 51-130611
Oct. 30, 1976 [JP] Japan ..... 51-130612
Oct. 30, 1976 [JP] Japan ..... 51-130613

[51] Int. Cl.[2] ..... B21J 9/10

[52] U.S. Cl. ..... 72/404; 72/427; 72/450; 72/453.18; 72/472

[58] Field of Search ..... 72/404, 446, 427, 472, 72/455, 450, 453.18, 405

[56] References Cited

U.S. PATENT DOCUMENTS

| | | | |
|---|---|---|---|
| 869,283 | 10/1907 | Winter | 72/421 |
| 1,726,731 | 9/1929 | Bartlett | 72/421 |
| 3,359,774 | 12/1967 | Bouchard | 72/405 |

*Primary Examiner*—C.W. Lanham
*Assistant Examiner*—Gene P. Crosby
*Attorney, Agent, or Firm*—Wenderoth, Lind & Ponack

[57] ABSTRACT

An automatic rotary die forging press includes a pair of vertically arranged top and bottom die bolsters each having a polygonal section and rectangular faces corresponding to those of the other bolster. The top die bolster having as a bearing thereof a suspended holder supported in a ram and the bottom die bolster having as a bearing thereof a stationary holder supported in a frame and both supported rotatably. The press further includes a rotary drive mechanism for rotating said top and bottom die bolsters simultaneously, uniformly and intermittently in the same direction.

9 Claims, 18 Drawing Figures

DIE FORGING PRESS

BACKGROUND OF THE INVENTION

This invention relates to a die forging press capable of effecting continuously several steps of die pressing process with a single unit of the press.

In a heretofore used die forging press in which each of a top die bolster fixed to a ram and a bottom die bolster fixed to a frame has a die mounted thereon, it was necessary, each time a different die pressing process is required, either to exchange the die or to transfer the work to other press.

In order to avoid such troubles, automatic continuous die forging presses have been proposed. For example, Japanese Utility Model Publication No. 14311/72 discloses a turret type multiple press machine in which a plurality of presses are arranged along a circle for effecting simultaneously a plurality of different steps of die pressing process while transferring the works through the working stations successively with the turret. Further, Japanese Patent Publication No. 31421/74 discloses a forging press in which a plurality of dies are arranged on a die stand which is moved horizontally in succession so that the dies are positioned at the required working stations. However, these prior art presses had disadvantages that they occupied relatively large space and that mounting, dismounting and positioning of the work in each step were difficult.

In the heretofore used die forging presses in which dies were mounted respectively on the top die bolster fixed to the ram and on the bottom die bolster fixed to the frame, the play in the bolster mounting sections resulted in a loss of forging pressure in the die pressing operation. Further, for adjustment of thickness of products or for correction of errors thereof, a separate lower dead point adjusting mechanism was necessary as means for adjustment of the position of the lower dead point of the top die.

SUMMARY OF THE INVENTION

An object of this invention is to provide an automatic rotary press for die forging capable of continuously effecting several steps of die pressing process are required.

Another object of this invention is to provide a top die bolster mounting apparatus of die forging press, capable of obviating said disadvantages of the heretofore existing apparatuses, eliminating the play in the mounting of the top die bolster, and easily adjusting the thickness of the products.

A further object of this invention is to provide an automatic knock-out mechanism of die forging press, capable of easily pushing out the work from the die in operative association with the forging process of the press.

A feature of the die forging press according to this invention is the provision of the top and bottom die bolsters each having a polygonal section and rectangular faces corresponding to those of the other bolster, and of the bolster rotating and driving mechanism for rotating said bolsters corresponding to the process so as to bring the required top and bottom dies into opposed position or for rotating said bolsters simultaneously, uniformly and intermittently in the same direction.

Another feature of the die forging press according to this invention is the construction making it possible that the top die bolster is pulled up by a cylinder until it is urged against the lower side of the ram, both the top and the bottom die bolsters are fixed to the ram or to the frame by a wedging mechanism, the amount in which the wedge fixes, at least, the top die bolster is adjustable so that the top die bolster can be positioned corresponding to the position of the bottom die bolster.

A further feature of the die forging press according to this invention is the construction comprising the top die bolster fixed to the ram moved up and down in accordance with the rotation of a crank shaft and the bottom die bolster fixed to the frame, in which each of said bolsters is provided therein with push up pieces and an operating rod having a pyramidal head for operating said push up pieces to thrust out push out rods, and the press is provided with an operating mechanism comprising a kick out bar having conical portions which are abutted by the outer ends of said operating rod, a push rod for transmitting the motion of a cam rotating with the crank shaft to said kick out bar, and a lever.

BRIEF DESCRIPTION OF THE DRAWINGS

The invention will be better understood from the following description taken in connection with the accompanying drawings in which.

DETAILED DESCRIPTION OF THE PREFERRED EMBODIMENTS

Figure 1:
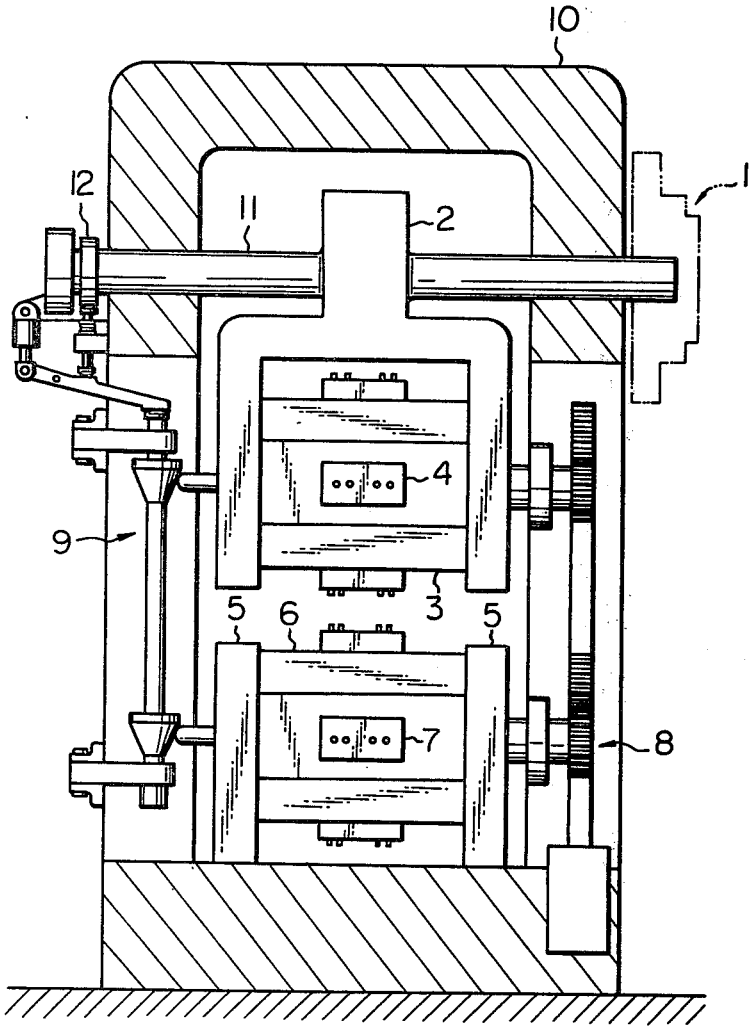
FIG. 1 is a schematic front view of an embodiment of this invention in which the invention is applied to a crank type die forging press as a typical example of mechanical presses.
Figure 2:
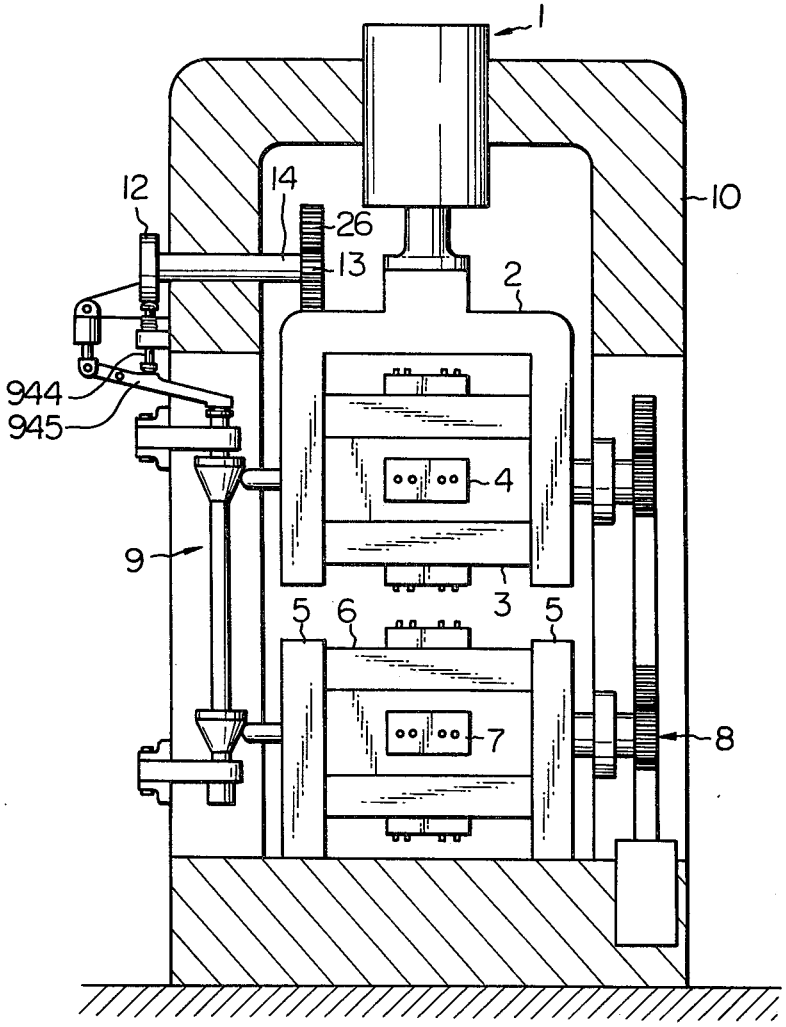
FIG. 2 is a schematic front view of another embodiment of this invention in which the invention is applied to a water pressure type die forging press as a typical example of hydraulic presses.

This invention is applicable to any of the mechanical or hydraulic presses as shown in FIG. 1 which is a schematic illustration of an embodiment in which this invention is applied to a crank type die forging press as a typical example of mechanical presses and in FIG. 2 which is a schematic illustration of an embodiment in which this invention is applied to a water pressure type die forging press as a typical example of hydraulic presses.

Figure 3:
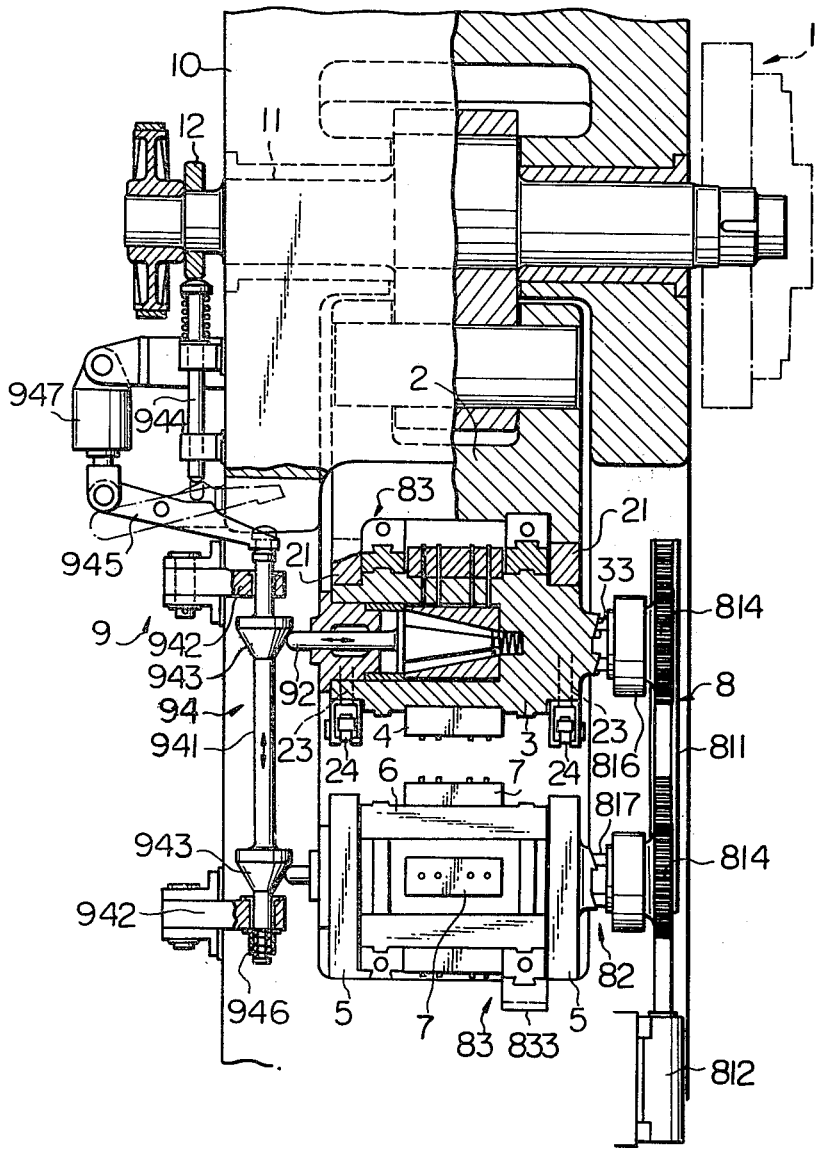
FIG. 3 is a partially broken away enlarged front view of the press shown in FIG. 1.
Figure 4:
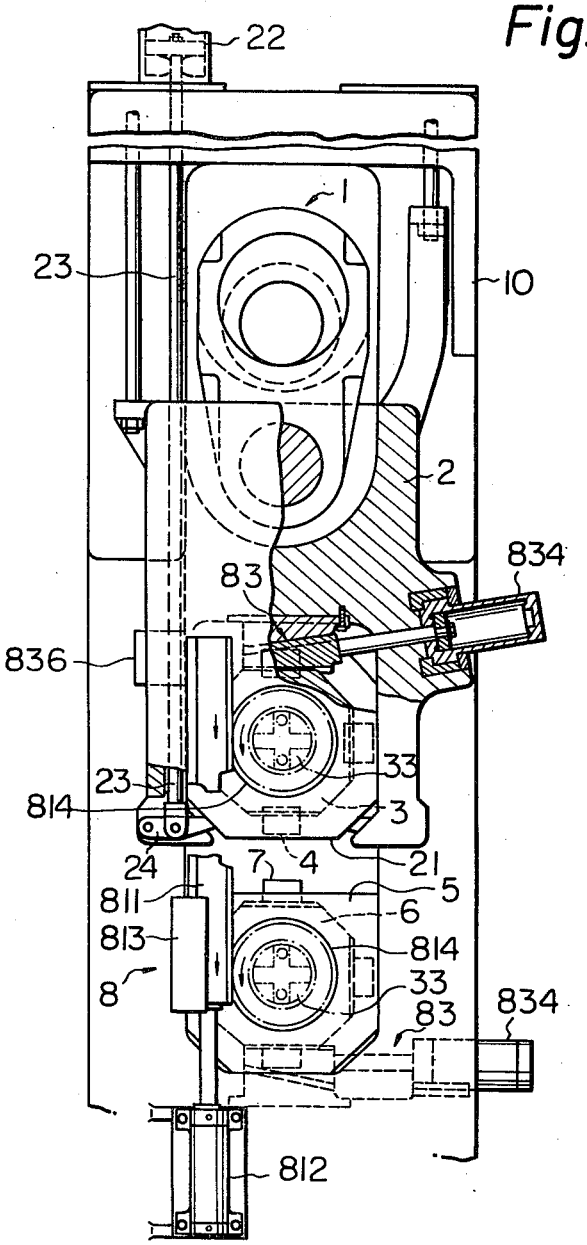
FIG. 4 is a partially broken away side view of the press shown in FIG. 3.

In FIGS. 1 and 2, the die forging press according to this invention comprises a frame 10, a forging load generating means 1, a ram 2, a top die bolster 3, top dies 4, a stationary holder 5, a bottom die bolster 6, bottom dies 7, a bolster rotating and driving mechanism 8, and a knock-out mechanism 9. The forging load generating means 1 is, in the mechanical press of FIG. 1, a known crank mechanism, and, in the hydraulic press of FIG. 2, a known hydraulic cylinder. Detailed structure and geometry of these members and mechanisms are shown in FIGS. 3 and 4.

As shown in FIGS. 1 to 4, the ram 2 is connected at the upper end thereof to the forging load generating means 1 and is formed at the lower end thereof into a gate-like shape between which the top die bolster 3 is rotatably supported. The top die bolster 3 has a polygonal section and is provided with top dies 4 fixed to the predetermined faces thereof. A knock-out mechanism 9 is attached in part within the bolster 3. A stationary holder 5 is fixed to a frame 10 and supports a bottom die bolster 6 rotatably. The bottom die bolster 6 is of the same structure and function as the top die bolster 3. Bottom dies 7 are fixed to the predetermined faces of the bottom die bolster 6. A bolster rotating and driving mechanism 8 rotates synchronously the top and the bottom die bolsters 3 and 6 and lock them at predetermined angular positions. The knock-out mechansim 9 in operative association with the forging load generating means 1 pushes out the processed work piece from the top and the bottom dies 4 and 7.

Since the top and the bottom die bolsters 3 and 6 are, as described hereinabove, of the same structure and function, only the top die bolster 3 will be described in detail hereinbelow to avoid needless repetition of description. In the embodiment shown in FIGS. 5 and 6, the body of the top die bolster 3 has on the side thereof rectangular faces 31*a*, 31*b*, 31*c*, and 31*d* having the top dies 4*a*, 4*b*, 4*c*, and 4*d* mounted thereon respectively. These top dies are respectively, for example, for preforming, die forging, trimming, and coining according to the required sequence of process. The number of the dies and the number of the faces of the bolster can be selected according to the required specification of working.

The top die bolster 3 is provided on each of the faces 31*a*, 31*b*, 31*c* and 31*d* thereof with a guide passage 32 engageable with each guide groove 832 of a wedge 831 of a locking assembly 83 to be described in detail hereinbelow.

The top die bolster 3 has a clutch indentation 33 formed on one end face thereof. Function of the clutch indentation 33 will be described in detail hereinunder in relation to the bolster rotating and driving mechanism 8.

The knock-out mechanism 9 has a part thereof inserted within the top die bolster 3, as shown in FIG. 3. The structure of the part of the mechanism 9 inserted within the bolster 3 will be described in detail hereinbelow.

The top die bolster 3 is provided at the opposite ends thereof respectively with bosses 34 each having a cylindrical outer peripheral face. The top die bolster 3 is rotatably supported at the bosses thereof by a suspended holder 21 supported by the ram 2 (see FIGS. 3 and 4). The bottom die bolster 6 is rotatably supported at the bosses thereof by the stationary holder 5 fixed to the frame 10.

The suspended holder 21 supporting the top die bolster 3 rotatably is, as shown in FIGS. 3 and 4, in a condition vertically floating with the bolster 3 relative to the ram 2. To keep these members always in close contact with the ram 2 in this embodiment, as best shown in FIG. 4, a pull rod 23 pulled by a fluid cylinder 22 mounted on the top of the frame 10 is connected to each of rotatably supporting members 24 pivotally secured to the lower end of the ram 2, so that the action of the pull rods 23 by the cylinder 22 is transmitted to the members 24 to thereby pull up the suspended holder 21 in the condition held from below as shown. In this way the suspended holder 21 is normally held in close contact with the underside of the ram 2. To remove the bolster 3 from the ram 2 for exchanging or adjusting the dies thereon, the pressure of the cylinder 22 is released. Then, the bolster 3 can be removed together with the suspended holder 21 from the ram 2.

Figure 7:
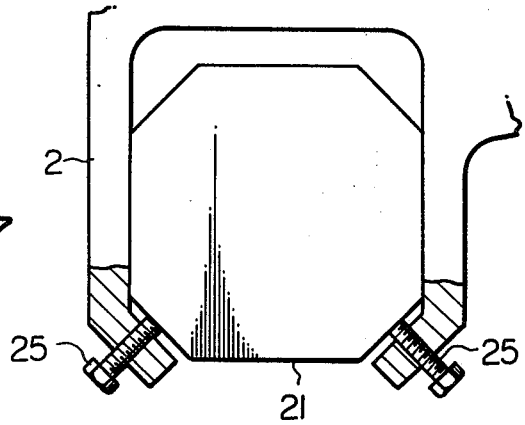
FIG. 7 is a partially broken away front view of the lower portion of a ram according to this invention.

Instead of said fluid cylinder 22 as the holding means for the suspended holder 21, a bolt 25 may be provided at each lower end of the ram 2, as shown in FIG. 7, for supporting the suspended holder 21, so that the suspended holder 21 is pressed and held against the underside of the ram 2 by tightening the bolts 25.

Figure 8:
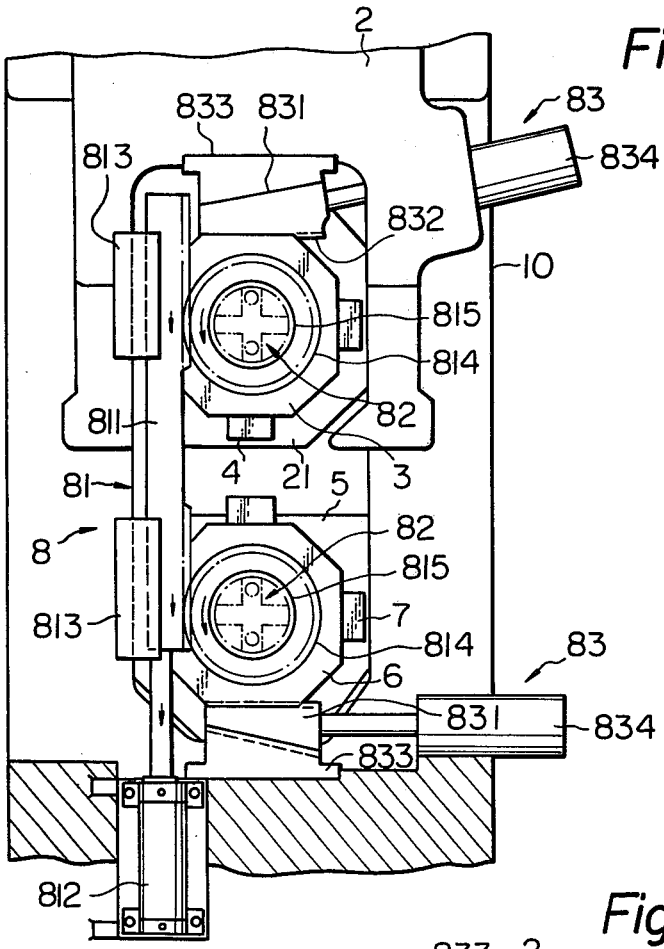
FIG. 8 is a side view of a bolster rotating and driving mechanism according to this invention.
Figure 10:
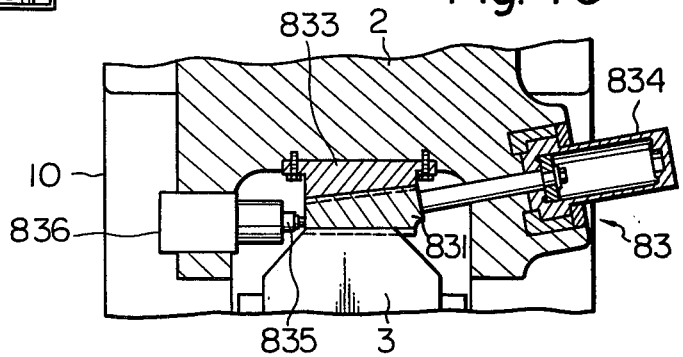
FIG. 10 is a vertical sectional view taken along the line X—X of FIG. 9 to show a locking assembly of the bolster rotating and driving mechanism.
Figure 9:
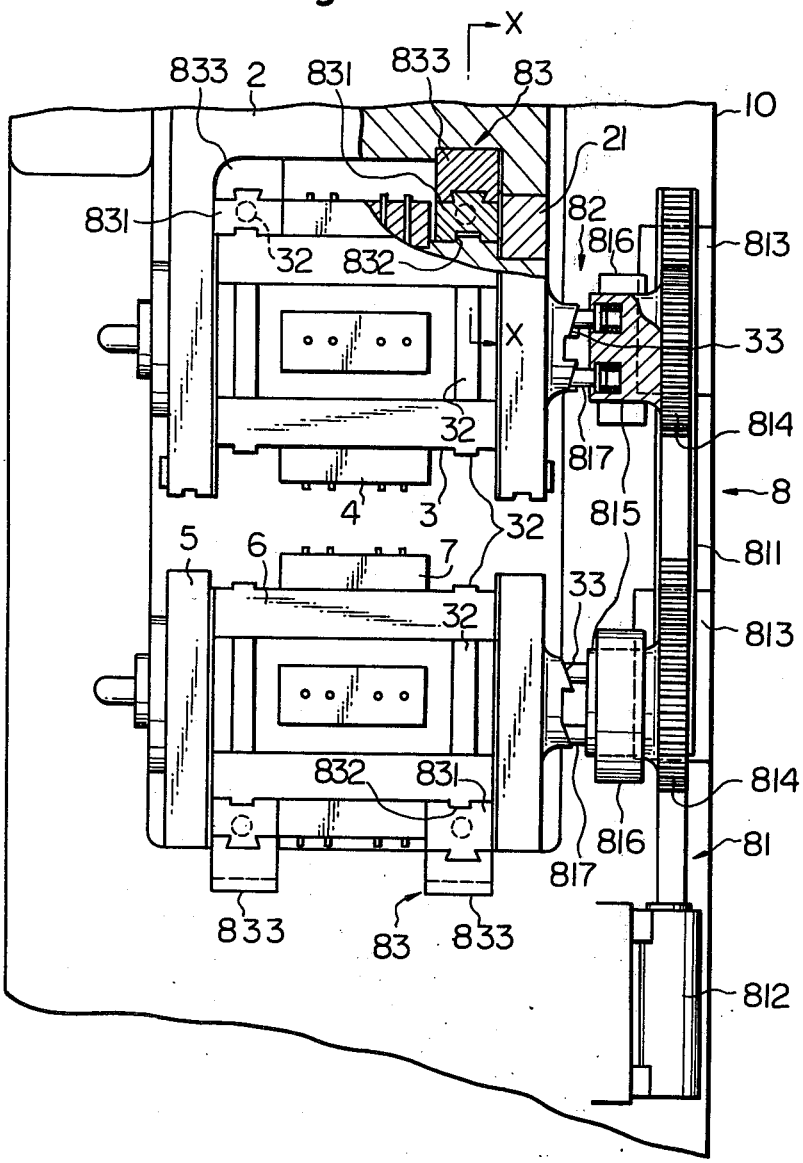
FIG. 9 is a front view of the mechanism shown in FIG. 8.

As described hereinabove, the top die bolster 3 is rotatably supported by the suspended holder 21 as the bearing, and the bottom die bolster 6 is rotatably supported by the stationary bolster 5 as the bearing. Further, as described hereinabove, the top and the bottom die bolster 3 and 6 have the dies required according to the sequenced process, mounted on the respective rectangular faces thereof. Accordingly, it is essential that the corresponding top and bottom dies are paired as required according to the process by the rotation of the bolsters 3 and 6 or that the bolsters 3 and 6 are rotated in the same direction synchronously and intermittently. For this purpose, in this invention, the bolster rotating and driving mechanism 8 is provided as best shown in FIGS. 8 to 10.

The bolster rotating and driving mechanism 8 comprises a rotating and driving assembly 81, a one-way clutch assembly 82, and the locking assembly 83. These assemblies will now be described in detail below.

The rotating and driving assembly 81 has the mechanism and the function such that a rack-toothed operating rod 811 is moved vertically in a straight line by a cylinder 812 fixed to the frame side. The operating rod 811 is supported by a bearing 813 fixed to the frame 10 and rotates pinions 814 in meshing engagement with the rack teeth in forward and reverse directions by its straight vertical movement in a predetermined amount. Pinion shafts 815 integral with said pinions 814 opposite to the top and bottom die bolsters 3 and 6 are supported by a bearing 816 fixed to the frame 10.

The one-way clutch assembly 82 is provided as the means for communicating the rotation of the pinion shafts 815 to the bolsters 3 and 6. Each of the pinion shafts 815 has a pair of retractable pins 817 each provided with a spring, mounted at an end face of the shaft, as shown in FIG. 9.

Figure 5:
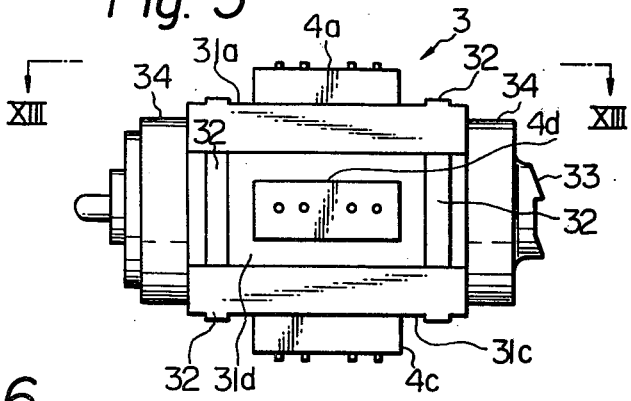
FIG. 5 is a side view of a bolster according to this invention.
Figure 6:
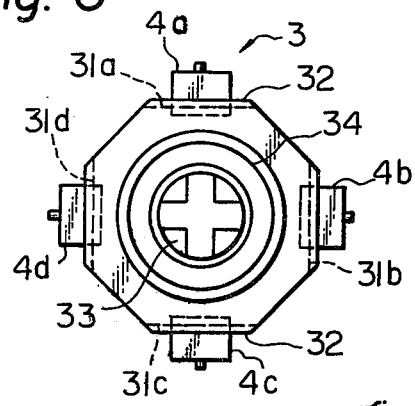
FIG. 6 is an end view of the bolster shown in FIG. 5.
Figure 11B:
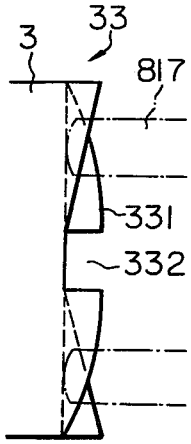
FIG. 11B is a side view of the clutch indentation shown in FIG. 11A.
Figure 11A:
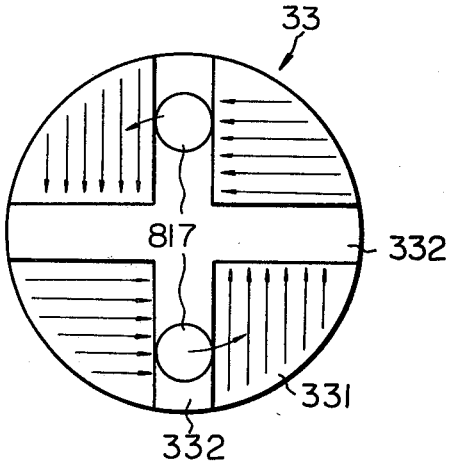
FIG. 11A is a front view of a clutch indentation of the bolster in an operating condition.
Figure 12B:
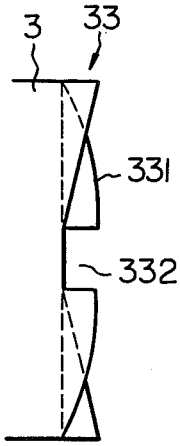
FIG. 12B is a side view of the clutch indentation shown in FIG. 12A.
Figure 12A:
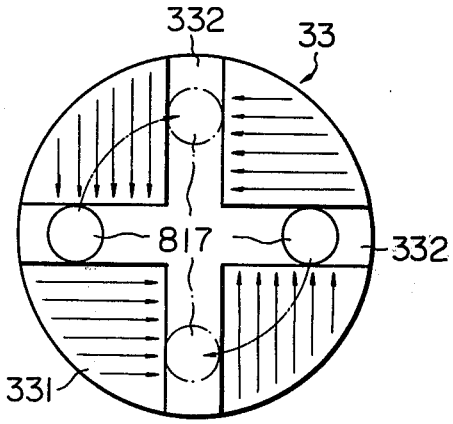
FIG. 12A is a front view of the clutch indentation of the bolster in another operating condition.
Figure 13:
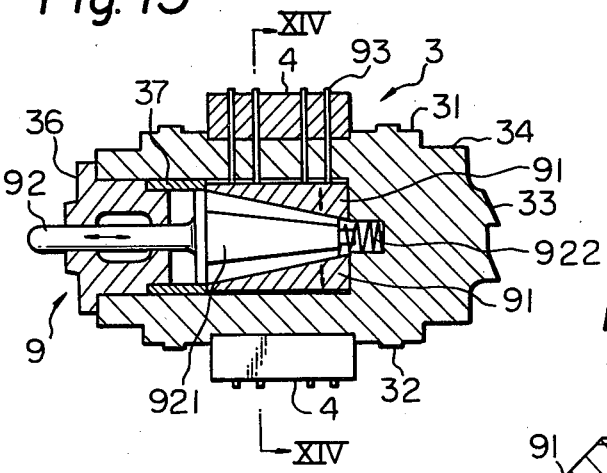
FIG. 13 is a vertical sectional view taken along the line XIII—XIII of FIG. 5.
Figure 14:
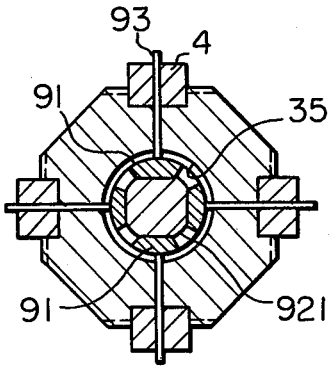
FIG. 14 is a cross sectional view taken along the line XIV—XIV of FIG. 13.

Each of the bolsters 3 and 6 has the clutch indentation 33 formed on an end face thereof as shown in FIG. 5. FIGS. 11 and 12 show the clutch indentation 33 in enlarged scale. The clutch indentation 33 is provided with a cross-shaped groove 332 formed by four projections each having a unidirectionally inclined face 331. The retractable pins 817 are fitted into and engaged with said cross-shaped groove 332. In FIGS. 11A and 12A, a plurality of straight arrows show the inclining directions of said inclined faces, namely that each of the faces is inclined downwardly in the direction shown by the arrows. Accordingly, when the pinions 814 are rotating in the forward direction (FIG. 11A), the retractable pins 817 are held by the wall of the cross-shaped groove 332 to transmit the rotation to the bolsters 3 and 6 to thereby rotate them in the predetermined amount (90°). On the other hand, when the pinions 814 are rotating in the reverse direction (FIG. 12A), the retractable pins 817 are guided by the inclined face of the projection and climb it backward. In other words, after the first die pressing process is completed, the bolsters 3 and 6 are rotated 90° in the forward direction. Then, the pinion shafts 815 are rotated 90° in the reverse direction to return the retractable pins 814 to the original position during which, however, the bolsters 3 and 6 are locked by the locking assembly 83 as will be described in detail below so as not to rotate in the reverse direction. The retractable pins 817 retracted in the pinion shafts 815 against the springs are projected in the position of the next cross-shaped groove 332 into engagement with the bolsters 3 and 6 to rotate them again in the forward direction. At this condition, the up and down movement of the bolster 3 is not hindered.

In short, the one-way clutch assembly 82 is required to rotate sequentially the top and the bottom die bolsters 3 and 6 in the predetermined amount in the forward direction in accordance with the die pressing process. The predetermined amount of rotation and the rotating and driving and rotational force transmitting mechanism are not to be limited to those described above. In fact, the above-described clutch mechanism may be replaced by, for example, a ratchet mechanism.

In this invention, the top and the bottom die bolsters 3 and 6 must be locked for each die pressing process and be unlocked for rotation after each die pressing process. For this purpose, in this embodiment, the locking assembly 83 is employed.

In the locking assembly 83, a wedge 831 provided on each of the right and left sides of both the bolsters 3 and 6 and having thereon a guide groove 832 is in meshing engagement with the passage 32 provided on a pressing face 31 of each of the bolsters 3 and 6. Further, the wedges 831 are guided by wedge rests 833 so as to be slidably movable in and out. In order to make it possible that the wedges 831 are pushed in to pressingly fix the bolsters 3 and 6 and are pulled out to release the bolsters from the press-fixed condition, a cylinder 834 is connected to each of the wedges 831 through the rod and piston. The wedge rest 833 and the cylinder 834 for the top die bolster 3 are mounted on the ram 2, and the wedge rest 833 and the cylinder 834 for the bottom die bolster 6 are mounted on the frame 10.

The top die bolster 3 is maintained at the proper vertical position by adjusting the amount of pushing-in of the wedge 831 therefor. For this purpose, each of the wedges 831 is, as shown in FIG. 10, provided with a stopper 835 opposite to the smaller end thereof and a hydraulic cylinder 836 for automatic control of the amount of pushing-out of the stopper 835. Other means such, for example, as mechanical means may be used for the automatic control of the amount of the pushing-out of the stopper 835.

Now, the knock-out mechanism 9 deemed to be indispensable to die pressing operation will be described in detail. As shown in FIGS. 3, and 13 to 16, the top and the bottom die bolsters 3 and 6 are each provided therethrough with a circular hole 35 receiving therein four push-up pieces 91 corresponding respectively to the rectangular faces 31 of the bolster 3 or 6 and a push up operating rod 92 having a pyramidal head 921, for operating the push up pieces 91. The rod 92 holds the push up pieces 91 with the head 921 thereof and operates them by moving the head 921 in and out. Namely, when the heads 921 are pushed by the operating rod 92 to the right in the drawing, the push up pieces 91 are simultaneously expanded radially outwardly to cause push out rods 93 corresponding to the respective rectangular faces 31 to be pushed out of the die 4 or 7. The push up operating rod 92 is held against the bolster 3 or 6 through a guide bearing 36 and a guide sleeve 37 and is provided at the tip end of the head 921 thereof with a spring 922 for biasing the push up operating rod 92 to be pushed back to the left in the drawing.

Figure 15:
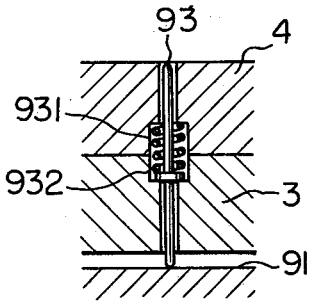
FIG. 15 is an enlarged sectional view of the push out rod shown in FIG. 13.
Figure 16:
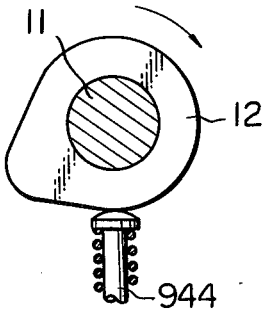
FIG. 16 is an enlarged view of a cam of the knock-out mechanism.

Each of the push out rods 93 is, as shown in FIG. 15 on an enlarged scale, biased radially inwardly by a spring 932 received in a recess 931 provided in a contact region between the die 4 or 7 and the bolster 3 or 6. Accordingly, in the condition in which the operating rod 92 is pushed out to the left in the drawing and the push up pieces 91 are movable a little radially inwardly in the drawing, the spring 932 pushes the push out rods 93 down until the upper ends thereof become lower than the surface of the die 4 or 7 to thereby have no affect on the locating of the work piece on the die.

Referring now to FIG. 3, an assembly 94 for operating the push up operating levers 92 will be described.

A kick out bar 941 supported by a rotary bearing 942 has conical portions 943 formed respectively on the upper and the lower portions thereof on the guide face of each thereof is abutted an end of the push up operating lever 92 so that the in-and-out movement of the push up operating lever 92 is effected by change in the position at which the operating lever 92 abuts said conical section 943, which is changed by the up-and-down movement of the kick out bar 941. In a mechanical press, the downward stroke of the kick out bar 941 is effected, as shown in FIG. 3, by a cam 12 mounted on a crank shaft 11 through a push rod 944 and a lever 945 with the required timing. Since the kick out bar 941 is biased normally upwardly by a spring 946 mounted on the lower end thereof, the return stroke thereof after the completion of the downward stroke is effected automatically.

In the case where the forging load generating means 1 is of the type using liquid pressure, a rack 26 is as shown in FIG. 2 provided vertically on the ram 2, a pinion 13 is provided in meshing engagement with the rack 26, and the cam 12 and the pinion 13 are connected by a suitable shaft 14 which is rotatably supported on the frame 10. With this construction, the kick out bar 941 is movable up and down in operative association to the up and down movement of the ram 2.

In the crank press shown in FIG. 3, a die pressing process is completed by one rotation of the crank shaft 11, namely during the first half rotation (180° rotation) of the crank shaft 11 the top die moves down to the lower dead point to effect die pressing and during the second half rotation of the crank shaft 11 the top die moves up to its original position. The outer configuration of the cam 2 is so determined that at a suitable timing during the second half rotation of said crank shaft 11 or during the return movement of the top die to its original position the push rod 944 is urged downward by the outer peripheral configuration of the cam 12 (see FIG. 16).

This technical idea is applicable to the case of the hydraulic press shown in FIG. 2.

In order to grasp up the work piece with the manipulator after completion of a die pressing process, the push out rod 93 must be further pushed up to lift the work piece from the die. For this purpose, the lever 945 is operated by a cylinder 947 mounted on the frame 10 to push down the kick out bar 941 further.

In FIG. 3, solid lines show the condition in which the crank shaft 11 is at the upper dead point after completion of a process and while standing still at this position the cylinder 947 has operated to push the kick out bar 941 to the extreme.

While the knock-out mechanism 9 has been described hereinabove to be in operative association with the rotation of the crank shaft, it may, of course, take other constructions such, for example, that a known knock-out mechanism is provided in each of the top and the bottom die bolsters.

To remove the bolster 3 or 6, the kick out bar 941 is swinged outward with the rotary bearing 942 as the fulcrum so as not to hinder the removing operation.

According to this invention, as obvious from the foregoing description, since several dies are mounted on each of the top and the bottom die bolsters, several steps of die pressing process can be successively effected with a single unit of press. Further, since the dies are brought to the operating position one after another by rotation of the bolster, scales produced during die forging operation are removed easily and surely, sufficient time is allowed to cool the dies, and lubricating oil is applied uniformly on the die faces.

Further, since the dies are mounted and dismounted together with the bolsters, time required therefor is substantially reduced.

Further, since the top die bolster is lifted by the cylinder and pressed against the ram, the apparatus has no play and loss in forging pressure is prevented.

Further, since the push out rods are projected from the inside to the outside of the dies surely and timely by the smooth movement of the kick out bars in operative association with the rotation of the crank shaft, forgings are separated from the dies easily and efficiently.

Coupled with the various advantages described above, the present invention provides a noticeable effect that die forging operation is carried out with a high accuracy and efficiency.

While we have shown and described specific embodiments of our invention, it will be understood that these embodiments are merely for the purpose of illustration and description and that various other forms may be devised within the scope of our invention, as defined in the appended claims.

We claim:

1. A die forging press, comprising:

a frame;

forging load generating means a ram connected to said means;

a top die bolster having a polygonal section and supported rotatably on said ram;

top dies mounted on predetermined faces respectively of said top die bolster;

a stationary holder fixed to the lower portion of said frame;

a bottom die bolster having a polygonal section and supported rotatably on said stationary holder, said bottom die bolster further having faces opposable to predetermined faces respectively of said top die bolster;

bottom dies mounted on predetermined faces respectively of said bottom die bolster, said bottom dies being paired with said top dies respectively;

a bolster rotating and driving mechanism for rotating said top and bottom die bolsters through a predetermined angle simultaneously and intermittently in the same direction; and a knock-out mechanism for moving pins provided slidably in said top and bottom dies into and out of said dies.

2. A die forging press as set forth in claim 1, in which said top die bolster is rotatably supported by a suspended holder which is adjustably supported on said ram.

3. A die forging press as set forth in claim 2, in which the means for adjustably supporting said suspended holder on said ram are bolts.

4. A die forging press as set forth in claim 2, in which the means for adjustably supporting said suspended holder on said ram are rotatably supporting members subjected to the action of pull rods pulled by a fluid cylinder located on the top of said frame.

5. A die forging press as set forth in claim 1, in which said bolster rotating and driving mechanism comprises:

a one-way clutch assembly connected to said top and bottom die bolsters;

a rotating and driving assembly connected to said one-way clutch assembly; and locking assemblies having wedges removably engageable with predetermined faces of said top and bottom die bolsters respectively.

6. A die forging press as set forth in claim 5, in which said rotating and driving assembly has pinions in meshing engagement with a rack operated by a fluid cylinder, and said one-way clutch assembly comprises clutch indentations formed on end faces of said top and bottom die bolsters and spring-biased pins provided at ends of said pinions and engaged with said clutch indentations.

7. A die forging press as set forth in claim 1, in which said knock-out mechanism comprises:

operating levers received in said top and bottom bolsters respectively and each having push up pieces and a pyramidal head for operating said push up pieces to protrude push out rods;

a kick out bar provided thereon with conical portions against which the outer ends of said operating levers abut;

a cam rotatable with the operation of said forging load generating means; and a push rod for transmitting the movement of said cam to said kick out bar.

8. A die forging press as set forth in claim 7, in which said forging load generating means has a crank mechanism to which said cam is attached.

9. A die forging press as set forth in claim 7, in which said forging load generating means has a hydraulic cylinder, a rack is fixed vertically to the ram connected to said cylinder, a shaft rotatably supported by said frame has said cam fixed to one end thereof and a pinion fixed to the other end thereof, and said pinion is engaged with said rack.

* * * * *